United States Patent [19]

Johnston et al.

[11] 4,215,796

[45] Aug. 5, 1980

[54] RADIO FREQUENCY SHIELD STRUCTURE

[75] Inventors: Robert A. Johnston, Lynchburg; Wallace G. Keesee, Rustburg, both of Va.

[73] Assignee: General Electric Company, Lynchburg, Va.

[21] Appl. No.: 37,737

[22] Filed: May 10, 1979

[51] Int. Cl.[2] ..... B65D 41/15

[52] U.S. Cl. ..... 220/306; 220/3.8; 220/62; 174/35 R

[58] Field of Search ..... 220/3.8, 62, 306; 174/35 R

[56] References Cited

U.S. PATENT DOCUMENTS 2,858,179 10/1958 Puerner et al. ..... 220/306 X

*Primary Examiner*—George T. Hall

*Attorney, Agent, or Firm*—James J. Williams

[57] ABSTRACT

A container type structure for providing a radio frequency shield is described having an integral latching means for securing a cover on the container, which latching means can readily be operated to allow the cover to be removed. The latching means are formed from a tongue-like member extending substantially parallel of the surfaces of the side walls of the container and resiliently biased in a direction for engagement with appropriate apertures or receptacles on the cover. Slots are provided through which the latch can be manipulated to allow ready removal of the cover.

10 Claims, 8 Drawing Figures

RADIO FREQUENCY SHIELD STRUCTURE

BACKGROUND OF THE INVENTION

This invention relates to a structure for a radio frequency shielding container, or container-like structure, and more particularly, to a latching mechanism by which a cover for such a container can be secured thereon and easily disengaged therefrom.

In the construction of various types of electrical or electronic circuitry it is often necessary to house certain components in containers or other such structures which are constructed and are of a material which will provide a shield against radio frequency energy. Such a shield might be necessary to prevent the radio frequency energy from impinging on the components in the container or to prevent radio frequency energy produced by the components in the container from reaching surrounding components. In the construction of such shielding containers, a removable cover must be provided to permit servicing or replacement of the components in the container. Since such containers are placed in a wide variety of environments and are subject to widely varying conditions, such as vibration or shock, it is necessary to provide a means by which the cover will be reliably secured under such conditions, but which will allow the cover to be easily removed.

The conventional forms of latching mechanisms presently being used include "dimples" either on the cover or on the container which engage with recesses on the other of the two members; this does not provide the reliable securing mechanism needed. Such dimples can be loosened, for example, by vibration. In other conventional forms of shielding containers, the container walls or the cover are equipped with tabs which can be bent over the other of these two members for securing purposes. The metals of which these tabs are usually made are such that repeated bending of the tabs generally causes weakening and breaking. Of course, it is possible to provide a securing mechanism in the form of screws and nuts extending through holes in the cover and container or through the use of other similar fastening devices. However, these fasteners constitute loose hardware when the container is opened which is subject to being lost and must be replaced. This can often prove difficult when servicing equipment having such containers, for example, in the field. In many instances, the cover is soldered, to the container, and this, of course, provides a generally reliable securing mechanism. However, this also constitutes a nearly permanent securing mechanism making the components in the container difficult to reach for servicing purposes.

Another common technique for providing a means for securing a cover to a container, such as the one here in question, is through the use of spring fingers placed either on the cover or in the container which are resiliently biased against the other of these two members. Thus, a resiliently urged friction grip is provided. While this is a convenient means for securing the cover, and one which permits ready removal, such a securing mechanism has been found to be generally unreliable when subject to unusual environmental conditions such as those mentioned above. An example of a securing mechanism of this type is to be found in U.S. Pat. No. 2,133,789 to E. J. Poole, issued Oct. 18, 1938.

It is, therefore, an object of this invention to provide a radio frequency shielding container structure having a latching mechanism for reliably securing a cover to the remainder of the container in such a way that the cover can easily be removed.

Another object of the invention is to provide in such a structure a latching mechanism which can be operated an indefinite number of time for removal of the cover without damaging the latching mechanism itself.

A further object of this invention is to provide in such a structure a latching mechanism which will reliably secure the cover to the container in such a way as to resist the effects of unusual environmental conditions, such as vibration or shock.

Another object of this invention is to provide in such a structure a latching mechanism which permits reliable securing of the cover to the container and ready removal without the use of loose hardware or the like which can easily be separated from the container when the cover is removed.

Still another object of this invention is to provide in such a structure a latching mechanism which can be produced at low cost, is simple to assemble without the use of special tools and meets the foregoing objects.

SUMMARY OF THE INVENTION

The foregoing and other objects are achieved in a radio frequency shielding structure or container having front and rear walls and opposed side walls. In addition, the container includes a removable cover member which is secured to the remainder of the container by means of resilient latch means on at least one of the side walls of the container. The resilient latch means engage latch receiving means formed at corresponding points in the cover member. In one form, the latch means is constructed from resilient leaf or tongue-like members on the container walls. The latch means are resiliently biased in the direction of engagement with the latch receiving means on the cover member. Thus, the latch means can readily be disengaged from the latch receiving means by simply moving the latch means in a direction opposite to the direction of engagement with the cover member. The latch receiving means can be in the form of openings formed in the cover member which are capable of receiving retaining members or protrusions extending from the tongue-like members so that when a latch and latch receiving means are engaged, the protrusions from the resilient tongue-like members extend through the openings to provide reliable securing of the cover to the container. Other openings can be provided in the cover member in close proximity to the latch receiving means so that a tool can be inserted therethrough to engage the latch means for moving it, dis-engaging it from the latch receiving means and allowing removal of the cover.

BRIEF DESCRIPTION OF THE DRAWINGS

The principles of the invention will be better understood by reference to the following description given in conjunction with the drawing in which.

DETAILED DESCRIPTION OF THE PREFERRED EMBODIMENTS

Figure 1:
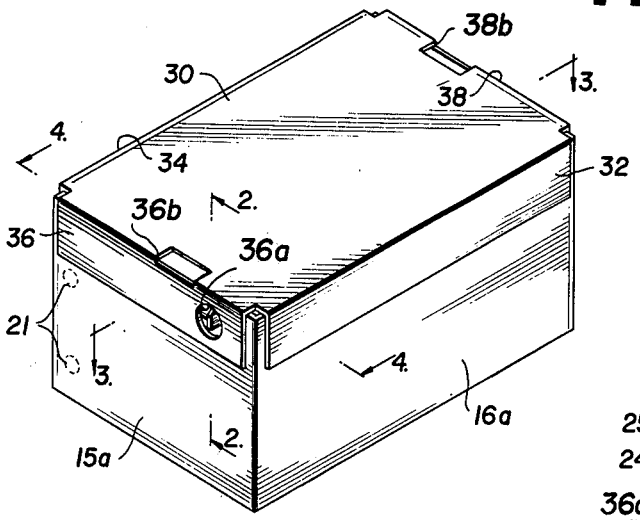
FIG. 1 is an isometric view of a radio frequency shielding container constructed according to the principles of the invention.
Figure 2:
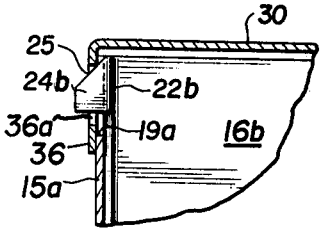
FIG. 2 is a partial cross-sectional view taken along the line 2—2 in FIG. 1.
Figure 3:
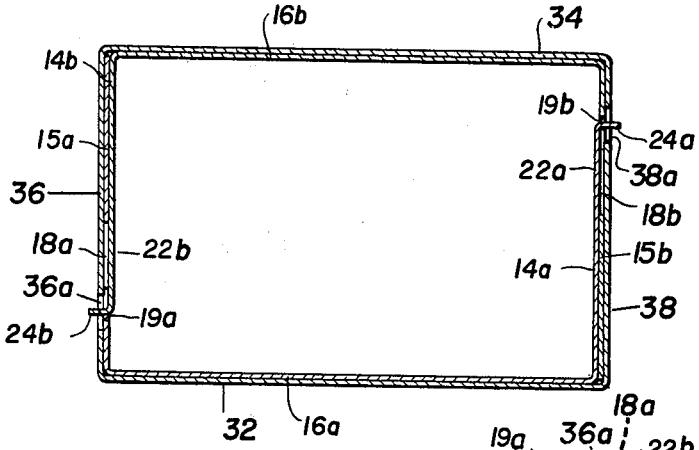
FIG. 3 is a top cross-sectional view taken along the line 3—3 in FIG. 1.
Figure 4:
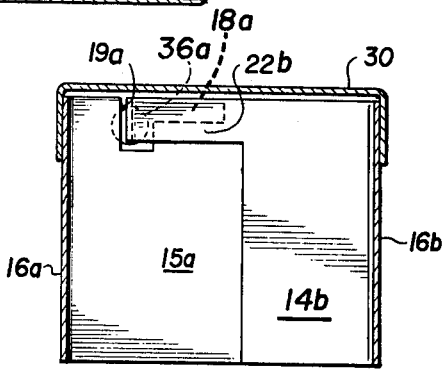
FIG. 4 is a side cross-sectional view taken along the line 4—4 in FIG. 1.
Figure 5:
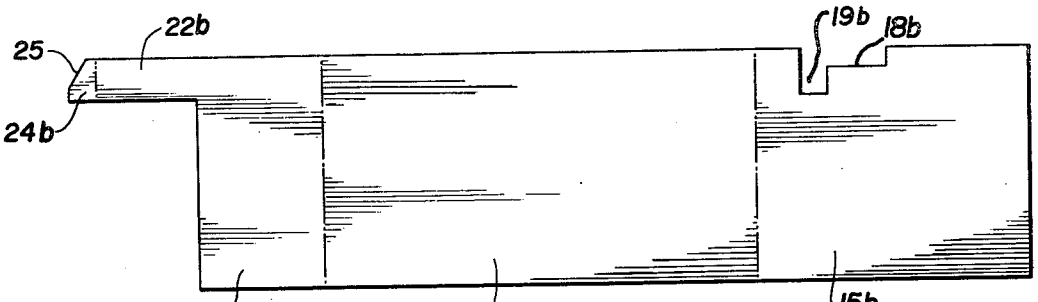
FIG. 5 is a plan view of a portion of the wall of a stamped member forming part of the FIG. 1 wall structure prior to being bent to form the walls.

In FIGS. 1 through 5, wherein like numerals refer to like parts, are illustrated views of a radio frequency shielding container constructed from a number of members and having front and rear walls 16a and 16b, opposed side walls 15a and 15b, and a cover 30. In this embodiment, the walls are formed from two similar metal stampings (one of which is shown in FIG. 5) bent to form two generally C-shaped members. The intermediate part of each C-shaped member forms the front and rear walls 16a and 16b respectively. One extending part of each C-shaped member forms the larger outer sides 15a and 15b respectively; and the other extending part of each C-shaped member forms smaller overlaps 14a and 14b which fits inside the outer sides 15b and 15a respectively. The two C-shaped parts are assembled as shown in FIG. 3, and may be spot-welded as shown at 21 in FIG. 1. When interleaved and joined as described and shown, a permanent four sided container is formed. While not shown, tangs or extensions may be provided at the lower edges of any of the walls or sides to engage and be soldered in appropriate slots in a circuit board or chassis.

Latches 22a and 22b are respectively formed in the overlaps 14a and 14b as shown particularly well for the latch 22b in FIGS. 4 and 5. Each of the latches so formed are leaf or tongue-like members having arms which extend parallel to the surfaces of the side walls 15a and 15b. At the ends of the arms, retaining members 24a and 24b are formed by bending the arms at substantially a right angle. These members are preferably provided with a bevel 25 at their upper corner. The retaining members 24a and 24b, respectively, extend through openings 19a and 19b formed in the side walls 15b and 15a. These openings 19a and 19b, respectively, permit the retaining members 24b and 24a of the latches 22b and 22a to protrude therethrough due to the interleaved form of construction. By proper selection of the metal or material used to form such containers, the latches 22a and 22b will have sufficient resilience (by bending if necessary) to be biased outwardly with respect to the side walls of the container and provide secure holding or retention. As seen in FIGS. 4 and 5, other openings 18a and 18b are provided in the side walls 15a and 15b to provide clearance for removing a cover 30, as will be explained.

The cover member 30 is provided to form the top of the container. In accordance with the invention, the cover 30 is designed to be readily removed from the container to permit servicing of the components placed within it. Although not shown, the cover may have a resilient pad or cushion placed on its interior surface to maintain pressure between the cover 30 and the container, so as to prevent cover and component vibration. The cover 30 is formed with front and rear rims 32 and 34 and side rims 36 and 38 which, when the cover 30 is placed on the container, engage and fit over and outside the corresponding walls thereon. Means for receiving the retaining members 24a and 24b of the latches 22a and 22b are provided in the side rims 36 and 38 in the form of openings or apertures 36a and 38a. These openings 36a and 38a are placed at appropriate points on the side rims 36 and 38 so that they will receive and engage the right angle retaining members 24b and 24a respectively.

When the cover 30 is to be placed on the container, it is moved downwardly until the side rims 36 and 38 of the cover 30 engage the retaining members 24b and 24a on the latches 22b and 22a. At that time, a slight additional pressure on the cover 30 causes the inner faces of the rims 36 and 38 to engage the beveled edges 25 of the retaining members 24b and 24a, and urge or force the resilient arms of the latches 22b and 22a inward until the openings 36a and 38a are adjacent or opposite the retaining members 24b and 24a respectively. When this occurs, the resilient bias of the latches 22b and 22a causes the retaining members 24b and 24a to move into and through the openings 36a and 38a. As shown in FIG. 2, the lower edge of the member 24b overhangs the lower part of the opening 36a so that the rim 36 cannot move upward. A similar condition exists on the opposite rim 38, and at any other location provided with this construction. In this way, the cover 30 is reliably secured to the top of the container.

In order to facilitate removal of the cover 30, and particularly to permit ready operation of the latches, openings 36b and 38b are provided in the upper face of the cover 30. These openings 36b and 38b are sufficiently near the openings 36a and 38a respectively and the latches 22b and 22a respectively to permit the insertion of a narrow blade (such as a screwdriver) for moving the retaining members 24b and 24a out of the latch receiving openings 36a and 38a so that the cover 30 can be removed. Space or clearance for the blade is provided by the openings 18a and 18b as seen in FIG. 3. It is possible also that the blade can be pressed inwardly directly against the retaining members 24b and 24a to operate the latches in the same manner. In any event, it can be seen that the latches are easily operated to permit removal of the cover. Thus, a radio frequency shielding container and latch mechanism have been provided which fully meet all of the objects set forth above, as well as others, in a simple to use and easy to manufacture structure.

Figure 6:
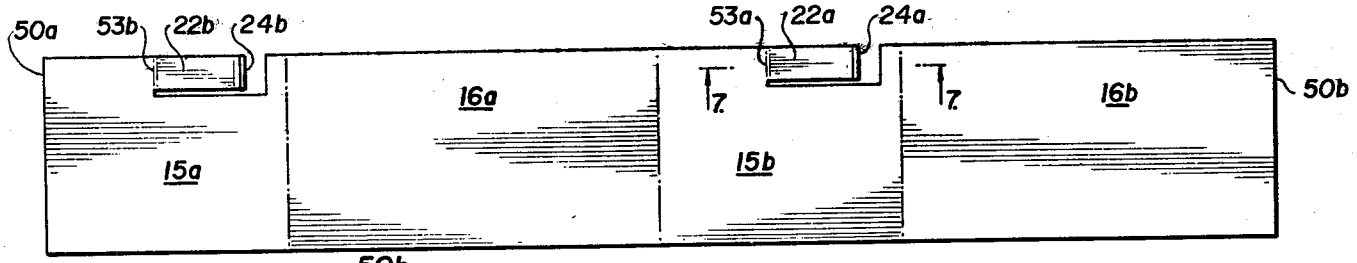
FIG. 6 is a plan view of an alternative to the FIG. 1 embodiment utilizing a single stamping for the entire wall structure.
Figure 7:
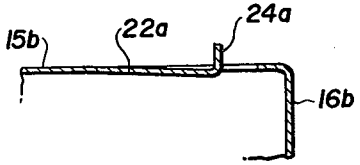
FIG. 7 is a partial cross-sectional view taken along line 7—7 in FIG. 6.
Figure 8:
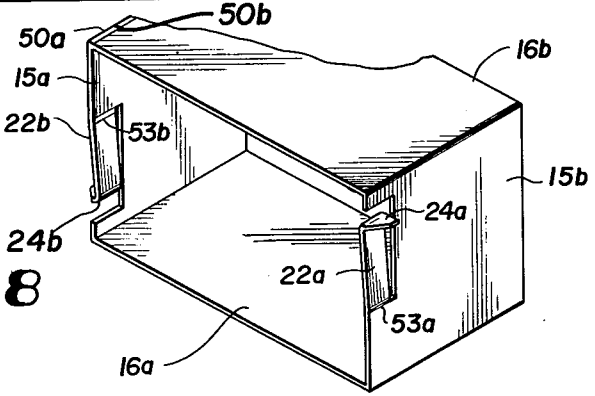
FIG. 8 is a partial perspective view of the FIG. 6 embodiment formed into a container structure.

FIGS. 6 through 8 illustrate an alternative form of construction and manufacture of the container described and shown above. This alternative container is formed from a single metal stamping to provide the front and rear walls 16a and 16b and the side walls 15a and 15b of the container. The container is formed by a simple bending operation followed by joining the edges 50a and 50b together to form the container. Similarly, latches 22a and 22b and retaining members 24a and 24b are formed by stamping and bending operations. These operations might also include forming slight bends 53a and 53b at the base of the latches 22a and 22b to provide resiliency and provide clearance for a screwdriver blade to actuate latches 22a and 22b.

Thus, it is readily apparent that the latch mechanism in accordance with the principles of this invention lends itself to the construction of the walls of a radio frequency shielding container and the latches entirely from a single stamped piece of material. The prior art latching mechanisms described hereinabove are not so constructed.

It is understood that the embodiments of the invention described hereinabove are intended only to be exemplary of its principles; these embodiments can be changed or modified in a variety of ways known to those skilled in the art without departing from the spirit and scope of the invention as defined by the appended claims.

What we claim as new and desire to secure by Letters Patent of the United States is:

1. A radio frequency shielding container, comprising:
   a. intersecting front, rear and opposed side walls;
   b. a cover member adapted to form a removable cover for the container formed by said walls;
   c. resilient latch means on at least one of said walls or on said cover member;
   d. latching receiving means on the other of said one wall or said cover member for engaging with said latch means for releasably securing said cover member on the container;
   e. said latch means comprising a resilient tongue-like member that extends parallel to the surface of said one wall, that is resiliently biased in the direction of engagement with said latch receiving means, and that terminates in an outwardly directed retaining member which is substantially perpendicular to said one wall;
   f. and wherein said latch receiving means comprise an opening formed at a location which will permit engagement with said retaining member of said resilient tongue-like member;
   g. whereby said latch means can be disengaged from said latch receiving means by manually moving said latch means in a direction opposite to said direction of engagement.

2. The container defined in claim 1 wherein said latch means are respectively attached to said opposed side walls, and wherein said latch receiving means are positioned on said cover member.

3. The container defined in claims 1 or 2 wherein said latch means are respectively formed out of, and are integral with, said opposed side walls.

4. The container defined in claims 1 or 2 wherein said walls are formed from a single piece of material bent to form the container.

5. The container defined in claims 1 or 2 wherein the container is formed from a plurality of members.

6. The container defined in claim 5 wherein the container is formed of two opposed C-shaped members wherein the intermediate legs of the C-shaped members form said front and rear walls, and wherein the extending legs of the C-shaped members interleave to form, respectively, said opposed side walls in two layers.

7. The container defined in claim 6 wherein one of said two layers forming each of said opposed side walls is cut out and shaped to form said latch means.

8. The container defined in claim 1 wherein said cover member is provided with additional openings situated proximate said latch receiving openings so that said latch means can be reached with a tool for disengagement from said latch receiving means.

9. The container defined in claim 1 wherein an outer edge of said retaining members is beveled to receive said cover member whereby the motion of said cover member closing the container urges said resilient tongue-like members inwardly to allow said cover member to pass.

10. In a radio frequency shielding container having front and rear walls, opposed side walls and a removable cover member, means for releasably securing said cover member comprising:
   a. resilient tongue-like members on and extending generally parallel to the surfaces of said side walls, and tongue-like members terminating in outwardly directed retaining members which extend substantially perpendicularly to said side walls; and
   b. openings formed in said cover member at locations thereon which will permit engagement with said retaining members of said resilient tongue-like members.

* * * * *